US009238233B2

(12) United States Patent
Morita

(10) Patent No.: US 9,238,233 B2
(45) Date of Patent: Jan. 19, 2016

(54) CENTRIFUGAL SEPARATOR WITH SHAFT SEALING MECHANISM FOR A CENTRIFUGAL SEPARATION BOWL ROTATABLE WITHIN A CASING

(71) Applicant: TOMOE ENGINEERING CO., LTD., Tokyo (JP)

(72) Inventor: Kenji Morita, Tokyo (JP)

(73) Assignee: TOMOE ENGINEERING CO., LTD., Tokyo (JP)

( * ) Notice: Subject to any disclaimer, the term of this patent is extended or adjusted under 35 U.S.C. 154(b) by 0 days.

(21) Appl. No.: 14/525,357

(22) Filed: Oct. 28, 2014

(65) Prior Publication Data

US 2015/0126352 A1 May 7, 2015

(30) Foreign Application Priority Data

Nov. 4, 2013 (JP) ..... 2013-228885

(51) Int. Cl.
*B04B 1/20* (2006.01)
*B04B 9/12* (2006.01)

(52) U.S. Cl.
CPC .... *B04B 9/12* (2013.01); *B04B 1/20* (2013.01)

(58) Field of Classification Search
CPC ..... B04B 1/20; B04B 9/12
USPC ..... 494/52–54, 38–41, 83–84, 7–9, 14–15; 210/380.1, 380.3; 184/6, 6.1, 6.12
See application file for complete search history.

(56) References Cited

U.S. PATENT DOCUMENTS

| | | | | |
|---|---|---|---|---|
| 4,154,394 | A * | 5/1979 | Reed | 494/38 |
| 4,167,243 | A * | 9/1979 | Jackson | 494/25 |
| 4,654,023 | A * | 3/1987 | Foldhazy | 494/41 |
| 5,364,335 | A | 11/1994 | Franzen et al. | |
| 8,652,021 | B2 * | 2/2014 | Yumoto et al. | 494/15 |
| 2015/0126352 | A1 * | 5/2015 | Morita | 494/15 |

FOREIGN PATENT DOCUMENTS

| | | | | |
|---|---|---|---|---|
| JP | 04-347071 | | 12/1992 | |
| JP | 07-217748 | | 8/1995 | |
| JP | 9-4722 | | 1/1997 | |
| JP | 9-506031 | | 6/1997 | |
| JP | 10-89491 | | 4/1998 | |
| JP | 11-336750 | | 12/1999 | |
| JP | 2000-329238 | | 11/2000 | |
| JP | 2002273268 | A * | 9/2002 | B04B 1/20 |
| JP | 2002-336687 | | 11/2002 | |
| JP | 2007-038160 | | 2/2007 | |
| JP | 2010-94611 | | 4/2010 | |
| JP | 2012-007634 | | 1/2012 | |
| JP | 2013-255870 | | 12/2013 | |
| WO | 95/15820 | | 6/1995 | |

* cited by examiner

*Primary Examiner* — Charles Cooley
(74) *Attorney, Agent, or Firm* — Young & Thompson

(57) ABSTRACT

The object of the present invention is to realize standardization of products of the vertical centrifugal separators so that it is no longer necessary to change the pressure-resistant design specifications of the bearing mechanism depending on the set pressure inside the casing. The vertical centrifugal separator having the bearing mechanism that is disposed in an opening of the casing and rotatably supports the rotary shaft of the bowl passing through the opening. The shaft sealing mechanism is a contactless shaft sealing mechanism.

6 Claims, 4 Drawing Sheets

CENTRIFUGAL SEPARATOR WITH SHAFT SEALING MECHANISM FOR A CENTRIFUGAL SEPARATION BOWL ROTATABLE WITHIN A CASING

TECHNICAL FIELD

The present invention relates to a vertical centrifugal separator, and particularly relates to a shaft sealing mechanism for a centrifugal separation bowl that is rotatable within a casing.

BACKGROUND ART

A separator disclosed in, for example, Patent Literature 1 is a decanter type centrifugal separator that performs a separation operation by applying a centrifugal force to a solution to be processed. In the centrifugal separator, a cylindrical bowl into which the solution to be processed is supplied is disposed inside a casing, and a drive mechanism (e.g., drive motor) for rotating the bowl is disposed outside the casing. A shaft serving as a rotary shaft of the bowl is rotatably supported by a bearing mechanism that is disposed so as to block an upper opening of the casing, and the power from the drive motor is transmitted to an end portion of the shaft extending to the outside of the casing. Also, a screw conveyor is disposed inside the bowl. The power from the drive motor is transmitted to the screw conveyor via a gear box serving as a differential rate generator, and accordingly the screw conveyor rotates at a rate (differential rate) having a difference relative to that of the bowl, thereby conveying a solid to an outlet.

The bearing mechanism for the shaft serving as the rotary shaft of the bowl includes a bearing that rotatably supports the shaft so that the shaft is rotatable, a housing that holds the bearing, and a mechanical seal that seals (shaft seal) a clearance portion between the housing and the shaft. The mechanical seal prevents leakage of a substance and the like within the casing to the outside of the apparatus and deterioration of the bearing and the like due to contact with the substance and the like within the casing. Conversely, the mechanical seal also prevents foreign matter from the outside air, a lubricating oil for the bearing, and the like from entering the inside of the casing through the clearance portion.

The mechanical seal has a portion where a fixed ring and a rotary ring come into sliding contact with each other, and heat is generated in this portion. If the amount of heat generation is large, the mechanical seal deteriorates. For this reason, the centrifugal separator further includes a means for supplying, in a circulating manner, a lubricating oil as a coolant. An oil unit including an oil tank, a pump, and a temperature regulator may be used as the means for supplying the lubricating oil in a circulating manner. The lubricating oil is supplied to the mechanical seal in a circulating manner while the pressure and the flow rate are adjusted, and thus the pressure balance of the shaft seal is adjusted.

However, with respect to centrifugal separators that adopt mechanical seals, it is necessary to change the pressure-resistant design specifications of portions of the bearing mechanism other than the mechanical seal depending on the set pressure inside the casing, and therefore such centrifugal separators have been divided into, for example, products for normal-pressure use and products for high-pressure use. For example, while centrifugal separators for normal-pressure use incorporate a labyrinth seal, centrifugal separators for high-pressure use cannot ensure pressure resistance with a labyrinth seal. Thus, centrifugal separators for high-pressure use have a structure in which, for example, a clearance bushing is provided instead of the labyrinth seal, and the pressure resistance is increased by, for example, adjusting the length of the clearance bushing. Therefore, there is no compatibility of spare parts and the like between centrifugal separators for normal-pressure use and centrifugal separators for high-pressure use. Furthermore, an on-site adjustment work for adjusting the pressure balance by adjusting gaps, shapes, and the like of various components (e.g., clearance bushing and the like) constituting the bearing mechanism has been burdensome. In particular, the higher the set pressure inside the casing, the more difficult the adjustment of the pressure and the flow rate of the lubricating oil.

Some decanter type centrifugal separators are of a horizontal type in which the bowl is placed in a horizontal orientation. Decanters of horizontal centrifugal separators have a structure in which the casing is vertically divided into two portions so that maintenance or removal of the bowl can be performed, and therefore have low pressure resistance and cannot be used under high-pressure conditions. In contrast, decanters of vertical centrifugal separators can be used under high-pressure conditions because a pressure tight vessel can be used as the casing. However, it is required that the bearing mechanism also be pressure-resistant. Moreover, adjustment of the pressure balance of the shaft seal is difficult. The vertical centrifugal separators have technical problems such as these described above, which the horizontal centrifugal separators do not have.

Also, there is a problem in that when terephthalic acid is subjected to solid-liquid separation under high pressure as described in Patent Literature 4, fine terephthalic acid powder that is diffused in the casing intrudes into a sliding portion of the mechanical seal and causes the mechanical seal to deteriorate. This problem is not limited to terephthalic acid, and the same problem may arise with respect to any matter to be processed that causes fine powder to be diffused in the casing.

CITATION LIST

Patent Literature

Patent Literature 1: Japanese Patent Laid-Open No. 2012-7634

Patent Literature 2: Japanese Patent No. 5048165

Patent Literature 3: Japanese Patent Laid-Open No. 2007-38160

Patent Literature 4: Japanese Patent No. 4907781

SUMMARY OF INVENTION

Problems to be Solved by the Invention

The present invention was made to solve the above-described problems, which are described by way of example, and an object thereof is to standardize the pressure-resistant design specifications of the bearing mechanism of vertical centrifugal separators so that it is no longer necessary to change the pressure-resistant design specifications of the bearing mechanism depending on the set pressure inside the casing, like for normal-pressure use or for high-pressure use, and to consequently realize standardization of products.

Another object of the present invention is to provide a centrifugal separator including a shaft sealing mechanism that is capable of maintaining sealing characteristics for a long period of time even when the set pressure inside the casing during centrifugal separation is a high pressure.

Still another object of the present invention is to provide a centrifugal separator including a shaft sealing mechanism that is capable of, even under an operation condition in which fine powder is diffused in the casing, preventing degradation of the sealing characteristics due to the fine powder.

Means for Solving the Problems (1) A vertical centrifugal separator comprising: a casing constituting a vessel; a centrifugal separation bowl that is rotatably disposed within the casing; a rotary shaft of the bowl, the rotary shaft being provided on an upper side of the bowl and extending in a vertical axis direction; a drive unit that is disposed outside the casing and rotates the rotary shaft; and a bearing mechanism that is disposed in an opening of the casing and rotatably supports the rotary shaft passing through the opening, wherein the bearing mechanism includes a housing that surrounds the rotary shaft, a bearing that rotatably supports the rotary shaft, and a shaft sealing mechanism that is disposed at an end portion of the bearing mechanism on the side of the casing and seals a clearance between the housing and the rotary shaft, and the shaft sealing mechanism is a contactless shaft sealing mechanism in which a rotary sealing ring is disposed on the side of the rotary shaft of the bowl, a stationary sealing ring including a seal assembly that opposes the rotary sealing ring is disposed on the side of the housing, and sealing is achieved by forming a static pressure space between the rotary sealing ring and the seal assembly using a sealing pressure gas whose pressure is adjustable, the pressure gas being introduced from outside.

(2) The first outlet through which a lubricating oil for the bearing is discharged and a second outlet through which the sealing gas leaking from the shaft sealing mechanism is discharged may be formed in that order from above in a portion of the clearance that extends from the bearing to the shaft sealing mechanism.

(3) The bearing mechanism preferably further includes a flowing-down preventing member that rotates together with the rotary shaft, thereby preventing the lubricating oil from flowing down to the shaft sealing mechanism, the flowing-down preventing member being located between the first outlet through which the lubricating oil for the bearing is discharged and the second outlet through which the sealing gas leaking from the shaft sealing mechanism is discharged.

(4) A supply path for supplying the pressure gas to the contactless shaft sealing mechanism and a collecting path for collecting the sealing gas leaking from the shaft sealing mechanism may be connected to the bearing mechanism, and a mist collecting device may be further connected to the sealing gas collecting path.

(5) The sealing gas collecting path may be connected to a tank that stores the lubricating oil for the bearing, and when the centrifugal separator is a centrifugal separator for high-pressure use in which an internal pressure of the casing is 0.1 MPa or more during centrifugal separation, the mist collecting device may be a buffer tank that opens to atmosphere, the buffer tank being disposed at an intermediate position of the collecting path.

(6) The sealing gas collecting path may be connected to a tank that stores the lubricating oil for the bearing, and when the centrifugal separator is a centrifugal separator for normal-pressure use in which an internal pressure in the casing is less than 0.1 MPa during centrifugal separation, the tank that stores the lubricating oil may have a structure that opens to atmosphere, and the tank doubles as the mist collecting device.

Advantageous Effects of Invention

According to the present invention, a vertical centrifugal separator is provided with a bearing mechanism including a housing that surrounds a rotary shaft of a bowl, a bearing that rotatably supports the rotary shaft, and a contactless shaft sealing mechanism that seals a clearance between the housing and the rotary shaft with a pressure gas, and thus forced circulation of a lubricating oil for the shaft sealing mechanism is no longer necessary. That is to say, the need for conventionally performed operations for adjusting the pressure and the flow rate of the lubricating oil for the shaft sealing mechanism is eliminated. Furthermore, the sealing characteristics can be changed by adjusting the pressure of the gas, and therefore conventionally performed operations for adjusting the pressure balance by adjusting gaps, shapes, and the like of various components constituting the bearing mechanism (e.g., providing a clearance bushing) are no longer necessary. As a result, there is no longer the necessity to change pressure-resistant design specifications of the bearing mechanism depending on the pressure, and thus standardization of products can be realized. Furthermore, in the case where nitrogen gas ($N_2$ gas) is used as the sealing gas, since suppressing the consumption of the $N_2$ gas saves energy, control for keeping a constant pressure difference between the $N_2$ gas and the processing pressure is effective.

Furthermore, according to the present invention, the contactless shaft sealing mechanism is adopted, and therefore deterioration of the sealing characteristics due to sliding wear, which has occurred in conventional mechanical seals, does not occur. Also, the contactless shaft sealing mechanism, which has no sliding contact portion, suffers less deterioration of the sealing characteristics that is caused by intrusion of fine powder. In the case of a horizontal type in which the bowl is placed in a horizontal orientation and supported at both ends, vibrations increase due to bending, and the shaft sealing mechanism therefore easily deteriorates due to wear and cannot be put into practical use. The present invention can realize application of a contactless shaft sealing mechanism that is able to be put into practical use to a centrifugal separator by applying the shaft sealing mechanism to a vertical centrifugal separator that causes fewer vibrations.

MODES FOR CARRYING OUT THE INVENTION

Hereinafter, a centrifugal separator according to a preferred embodiment of the present invention will be described with reference to the accompanying drawings. However, the technical scope of the present invention should not be construed as being limited in any way by the description of the embodiment below.

Figure 1:
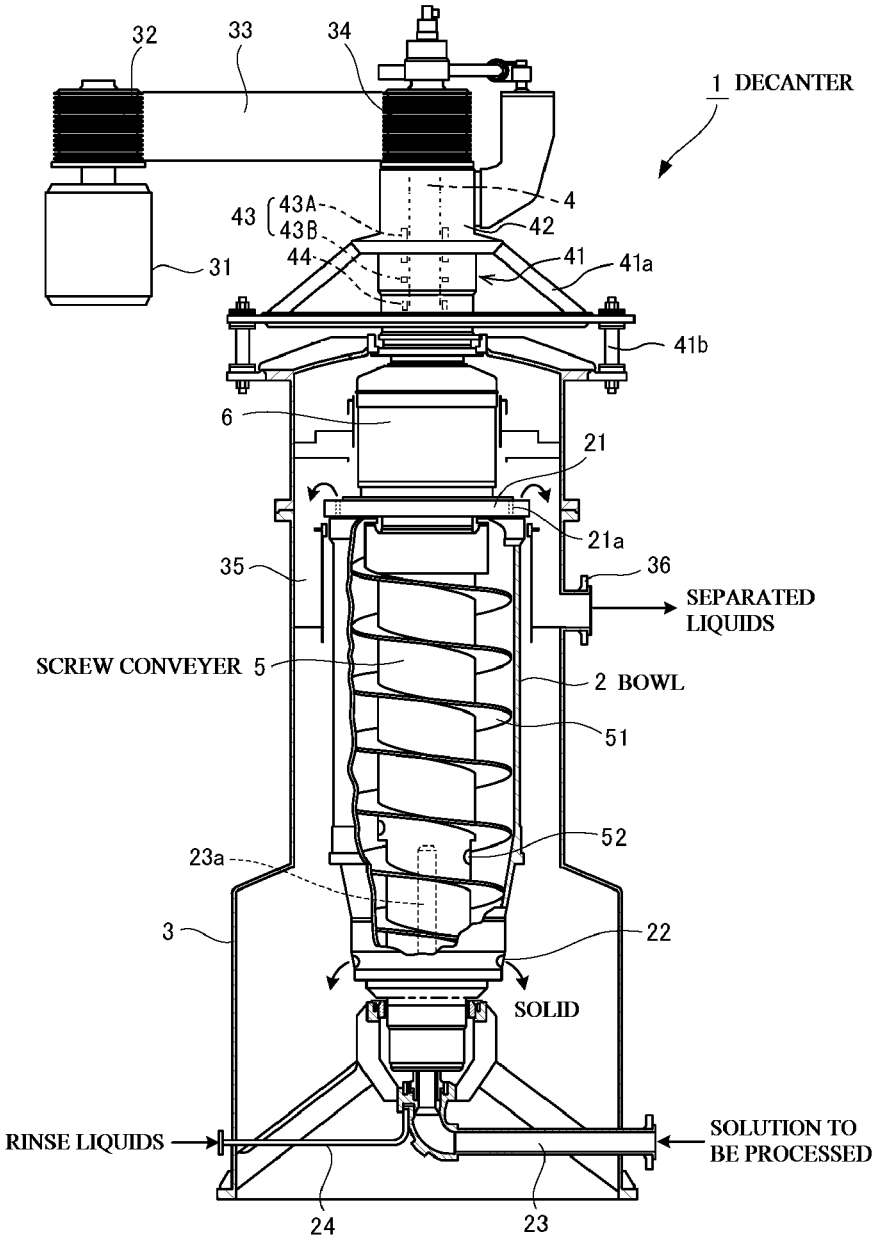
FIG. 1 shows the configuration of a decanter according to a preferred embodiment of the present invention.

FIG. 1 shows the overall configuration of a centrifugal separator according to this embodiment. In FIG. 1, a vertical decanter 1 is shown as an example of the centrifugal separator. The decanter 1 includes a bowl 2 serving as a rotatable body for applying a centrifugal force to a solution to be processed. The bowl 2 is a generally cylindrical rotatable body in which the solution to be processed can be held and applies a centrifugal force that is necessary for separation to the solution to be processed. The bowl 2 is disposed so as to be rotatable about a vertical axis within a casing 3. The casing 3 is a vessel that forms a processing space for centrifugal separation, and is designed to be a pressure vessel in the case where centrifugal separation is performed with a high processing pressure. For example, in the case where the decanter 1 is for high-pressure use, the processing pressure is in a range of 0.1 to 1.62 MPa, and in the case where the decanter 1 is for normal-pressure use, the processing pressure is in a range of 0 to 0.1 MPa.

Also, for example, a drive motor 31 that is disposed outside the casing 3 is used as a drive unit for rotating the bowl 2. The output of the drive motor 31 is, for example, inverter-controlled so as to rotate the bowl 2 at a predetermined rotation rate. The driving force from the drive motor 31 is transmitted, for example, via an endless rotary belt 33 running over a pulley 32, to a pulley 34 on the side of the bowl 2. However, the driving force transmission scheme is not limited to this configuration.

A shaft 4 serving as a rotary shaft of the bowl 2 is rotatably supported by a bearing mechanism 41 so as to be rotatable about a vertical axis, the bearing mechanism 41 being disposed in an upper opening of the casing 3. The bearing mechanism 41 is supported, via a support member 41*a* formed on a lateral circumferential surface of the bearing mechanism 41, by a vibration prevention unit 41*b* that is based on the casing 3. In the vertical decanter 1, the bowl 2 rotates in a state in which it is suspended from the bearing mechanism 41 by the shaft 4, and thus there are cases where displacement of the axis of the rotary shaft occurs due to vibrations. To address this issue, the vibration prevention unit 41*b* is provided so that vibrations that are generated during centrifugal separation are absorbed. The vibration prevention unit 41*b* may be, for example, an isolator and is configured to absorb vibrations by using an elastic force of rubber or the like.

A disk member 21 referred to as "front hub" is disposed on a top side of the bowl 2, and an outlet (separated liquid outlet) 21*a* through which a separated liquid is discharged is formed in the disk member 21. On the other hand, an outlet (solid outlet) 22 through which a separated solid is discharged is formed on a bottom side of the bowl 2. A screw conveyor 5 for conveying the solid to the solid outlet 22 during centrifugal separation is disposed within the bowl 2. The screw conveyor 5 rotates at a rate having a difference relative to the rotation rate of the bowl 2, and conveys the solid to the solid outlet 22 by means of a screw vane 51 that is formed in a spiral shape. For this purpose, the bowl 2 and the screw conveyor 5 are connected to a gear box 6 serving as a differential rate generator, and when the bowl 2 is rotated by the drive motor 31, the rotation rate is changed through the gear box 6, so that the screw conveyor 5 is rotated at a rate having a difference relative to the rotation rate of the bowl 2. On the other hand, the solution to be processed is continuously supplied into the bowl 2 through a supply nozzle 23, and thus the separated liquid after separation of the solid is discharged (so-called "overflowing") through the outlet 21*a*. The separated liquid discharged from the bowl 2 is supplied to a gutter-shaped liquid receiving portion 35 that is formed on an inner circumferential surface of the casing 3, and then discharged to the outside of the apparatus via a discharge nozzle 36 that is in communication with the liquid receiving portion 35.

The lower end side of the bowl 2 and the screw conveyor 5 is open, and a leading end 23*a* of a supply nozzle 23 is inserted into this opening in such a manner that the supply nozzle 23 is not in contact with the rotating bowl 2 and screw conveyor 5. When the solution to be processed is supplied to a cavity (buffer) that is formed within the screw conveyor 5, the solution to be processed is supplied by the centrifugal force to the inside of the bowl 2 through a liquid discharging port 52 that is formed in a trunk of the screw conveyor 5. In addition, the leading end 23*a* of the supply nozzle 23 is formed to have a double-tube structure, and the outer tube is in communication with a rinse liquid supply nozzle 24. A rinse liquid can be supplied into the bowl 2 in order to wash away the separated solid, for example. However, the rinse liquid is not necessarily required. Also, the screw conveyor 5 can be omitted in the case of batch-type centrifugal separation.

Figure 2:
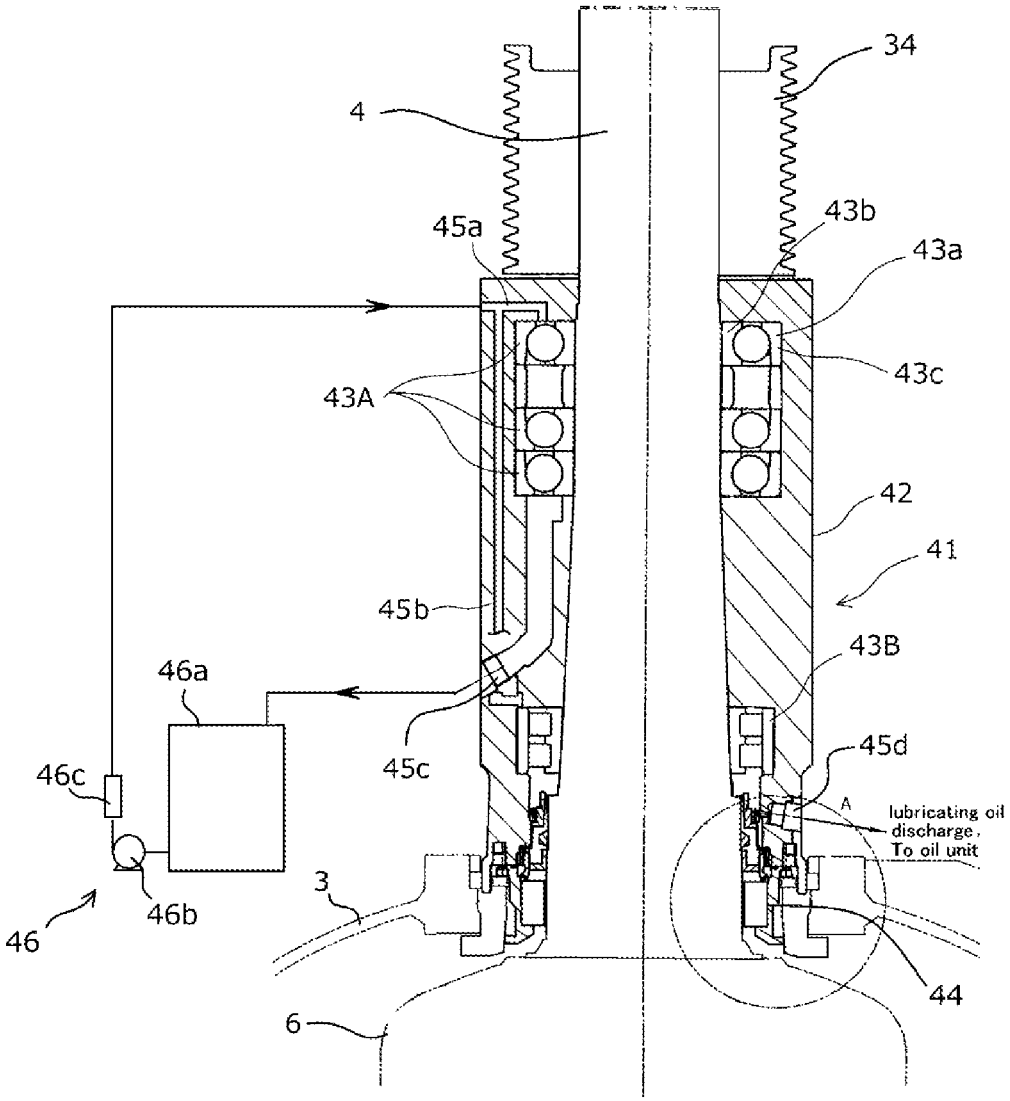
FIG. 2 is a vertical cross-sectional view of the bearing mechanism of the decanter.
Figure 3:
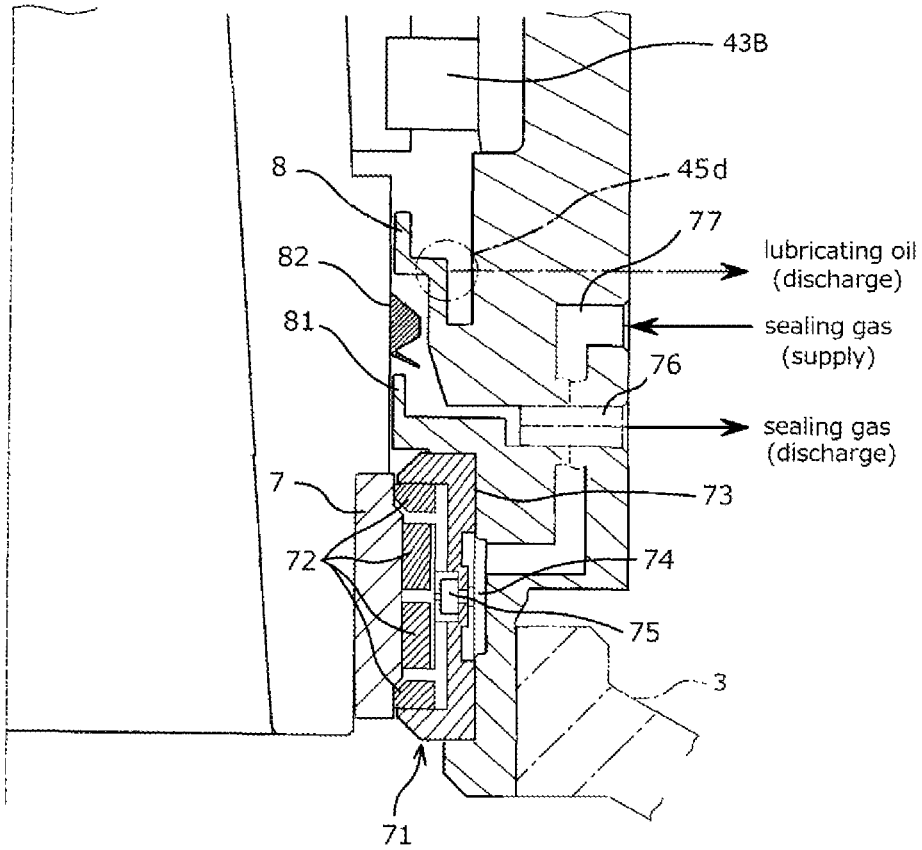
FIG. 3 is an enlarged view of the shaft sealing mechanism of the bearing mechanism.

Next, an internal structure of the bearing mechanism 41 will be described in detail with reference to FIGS. 2 and 3. FIG. 2 is a vertical cross-sectional view of the bearing mechanism 41, and FIG. 3 is an enlarged view of a portion A in FIG. 2. First, as shown in FIG. 2, the bearing mechanism 41 includes a housing 42 that is disposed so as to surround the shaft 4, which serves as the rotary shaft of the bowl 2. The housing 42 is configured to oppose an outer circumferential surface of the shaft 4 while being spaced apart therefrom by a slight gap (clearance) so as not to interfere with the rotating operation of the shaft 4. Thus, a shaft seal for sealing the clearance is necessary.

The housing 42 also acts as a holder for holding bearings 43 (43A, 43B) that are arranged in an axial direction of the shaft 4 and the shaft sealing mechanism 44. Thus, flow paths for supplying the lubricating oil and a gas for the shaft seal to the bearings 43 (43A, 43B) and the shaft sealing mechanism 44 are formed within the housing 42.

The bearings 43A are, for example, angular contact ball bearings of the bearing mechanism 41, and three bearings 43A are arranged on the upper side in the axial direction. On the other hand, the bearing 43B is, for example, a roller bearing of the bearing mechanism 41 and is arranged on the lower side in the axial direction above the shaft sealing mechanism 44. The shaft 4 is rotatable due to these bearings 43 (43A, 43B) and is set so as to rotate at a high speed in a range of, for example, 1000 G to 3200 G (1400 to 6000 rpm) during centrifugal separation. Each of the bearings 43A is configured such that an outer circumferential ring (fixed ring) 43*a* is fixed to an inner circumferential surface of the housing 42, an inner circumferential ring (rotary ring) 43*b* is fixed to an inner circumferential surface of the shaft 4, and the inner circumferential ring 43*b* rotates together with the shaft 4 via balls serving as rolling elements 43*c*. Similarly, the bearing 43B is configured such that an inner circumferential ring thereof rotates together with the shaft 4 via cylindrical rollers serving as rolling elements.

In this embodiment, a configuration is adopted in which the bearings 43 are lubricated by forced circulation of an oil. For this purpose, an oil supply port is formed in the housing 42, and a flow path 45*a* is in communication therewith, the flow path 45*a* supplying the oil from above the uppermost bearing. An injection nozzle may also be added to supply the oil by injection. In addition, a flow path 45*b* that supplies the oil to the bearing 43B is connected to the oil supply port. During centrifugal separation, the oil is supplied to both the bearings 43A and the bearing 43B. Furthermore, an oil collection port 45*c* is formed in the housing 42 to collect the oil supplied to the bearings 43A. On the other hand, aside from the oil collection port 45*c*, an oil outlet 45*d* is formed below the bearing 43B. The oil supplied to the bearing 43B is discharged through the oil outlet 45*d*. The oil outlet 45*d* also has a function of preventing the oil from flowing down to the shaft sealing mechanism 44 through the clearance.

The oil supply port, the oil collection port 45*c*, and the oil outlet 45*d* are connected in a loop to an oil unit 46 via, for example, piping, so that the oil is recycled. The oil unit 46 includes an oil tank 46*a*, a pump 46*b*, and an oil temperature regulator 46*c* and is capable of supplying the oil at a predetermined temperature and a predetermined pressure. It should be noted that although the configuration in which the three angular contact ball bearings 43A are arranged in the axial direction and the single, roller bearing 43B is disposed is shown, the types and the number of bearings are not limited to this configuration, and it is also possible to use bearings of other types and to increase or decrease the number of bearings.

Shaft Sealing Mechanism:

The shaft sealing mechanism 44 for sealing the clearance between the housing 42 and the shaft 4 is disposed at a lower end portion of the bearing mechanism 41. The shaft sealing mechanism 44 that is adopted in this embodiment is a contactless shaft sealing mechanism that, unlike a mechanical seal having a sliding contact portion, performs sealing by filling a space between a sealing ring on the inner circumferential side and a sealing ring on the outer circumferential side with a pressure gas. It should be noted that although an example of the configuration of the shaft sealing mechanism is shown in FIG. 3, the present invention is not limited to this configuration, and it is possible to adopt a known contactless shaft sealing mechanism called a gas seal.

Referring now to FIG. 3, a sealing ring (hereinafter referred to as "rotary sealing ring") 7 on the inner circumferential side of the shaft sealing mechanism 44 is a tubular sleeve member, and is fixed to the outer circumferential surface of the shaft 4 so as to be rotatable together with the shaft 4. On the other hand, a sealing ring (hereinafter referred to as "stationary sealing ring") 71 on the outer circumferential side includes a plurality of seal assemblies 72 that are arranged at spacings in the axial direction. Each seal assembly 72 is a ring-shaped member constituted by a plurality of block members that are arranged in a circumferential direction. The seal assemblies 72 can be biased toward the shaft axis by, for example, an elastic member (not shown). A garter spring or the like can be used as the elastic member. Opposing surfaces of the seal assemblies 72 and the rotary sealing ring 7 constitute a region in which a seal surface will be formed by the pressure gas later.

Reference numeral 73 indicates a holder having side walls at upper and lower end edges, respectively, and thus having a generally U-shaped cross section. The seal assemblies 72 are accommodated in an interior region of this holder 73. A gas inlet port 74 for introducing the pressure gas for sealing into the holder 73 is formed in the holder 73, and a flow path 75 for guiding the pressure gas to a contact region between the rotary sealing ring 7 and the seal assemblies 72 is formed inside the holder 73. When the pressure gas is supplied via the gas inlet port 74, the pressure gas enters in between the opposing surfaces of the seal assemblies 72 and the rotary sealing ring 7 and causes the seal assemblies 72 to be spaced slightly apart from the rotary sealing ring 7, thereby forming a static pressure space. Thus, a contactless sealing surface is formed between the rotary sealing ring 7 and the seal assemblies 72.

Generally, it is desirable that the contactless shaft sealing mechanism 44 minimizes leakage of the sealing gas. However, in the case of the decanter 1, which is likely to generate vibrations during centrifugal separation due to its structure, the gas easily leaks through gaps between the rotary sealing ring 7 and the side walls of the holder 73. The gas leaking downward in the axial direction enters the inside of the casing 3, and for this reason, an inert gas (preferably nitrogen) that has only a slight influence on the matter to be processed is used as the sealing gas. On the other hand, the gas leaking upward in the axial direction enters the clearance of the housing 42, and for this reason, a configuration is adopted in which the leaking gas is discharged through a gas outlet 76 (second outlet) that is formed at a position below the lubricating oil outlet (first outlet) 45*d* of the bearing 43B.

The gas inlet port 74 of the holder 73 is in communication with a gas supply port 77 via a flow path that is formed in a member constituting the housing 42. The gas supply port 77 is connected to a gas supply source via, for example, piping. For example, in the case where nitrogen is used as the sealing gas, a gas supply source such as a nitrogen generator or a nitrogen cylinder can be used as the gas supply source. The sealing gas is supplied at a pressure that is higher than at least the casing's internal pressure. Furthermore, in order to maintain the shaft sealing characteristics, and more specifically in order to keep the pressure balance of the shaft seal constant, it is preferable to provide a pressure control valve at an intermediate position of the piping and control the pressure of the gas.

Still referring to FIG. 3, a first guide member 8 is disposed in a portion of the clearance that is located above the shaft sealing mechanism 44, the first guide member 8 restricting the lubricating oil for the bearings 43 (especially bearing 42B) from flowing down to the shaft sealing mechanism 44 and also guiding the lubricating oil toward the oil outlet 45*d*. The first guide member 8 is a ring-shaped member surrounding the entire circumference of the shaft 4. The first guide member 8 has at its leading end a part having an L-shaped cross section and opposing the shaft 4 across an extremely slight gap, and forms a gutter for guiding the lubricating oil that is forced to the outer side by the centrifugal force during operation toward the oil outlet 45*d*.

Furthermore, a second guide member 81 having generally the same shape as the first guide member 8 is formed under the first guide member 8. The second guide member 81 forms a gutter for guiding the lubricating oil toward the gas outlet 76 in order to prevent the lubricating oil that the first guide member 8 has failed to block from flowing down to the shaft sealing mechanism 44. Furthermore, in this embodiment, in order to more reliably prevent the lubricating oil from flowing down to the shaft sealing mechanism 44, a third guide member 82 serving as a flowing-down preventing member is disposed at a position that is located above a clearance between the second guide member 81 and the shaft 4. The third guide member 82 is, for example, a V ring and is fixed to the shaft 4. The third guide member 82 rotates together with the shaft 4, thereby providing an effect of repelling the lubricating oil so that the lubricating oil is directed to the outer side (i.e., the gas outlet 79).

Generally, a gas seal uses air or an inert gas, which are harmless, as the sealing gas, and moreover only a small amount of the gas leaks. Therefore, the leaking gas is not particularly collected, but is released to the atmosphere. However, with respect to the vertical decanter 1 of this embodiment, when a test was actually conducted, it was found that a stable operation cannot be performed if the leaking gas is not collected. That is to say, the two types of fluids, the lubricating oil (liquid) and the sealing gas, flow inside the bearing mechanism 41, and this leads to a state in which an oil mist is contained in the sealing gas. Furthermore, the decanter 1 is likely to generate vibrations, and the amount of leakage of the gas may increase due to the vibrations. Thus, if no measure is taken, the amount of lubricating oil in the circulating system decreases.

Figure 4:
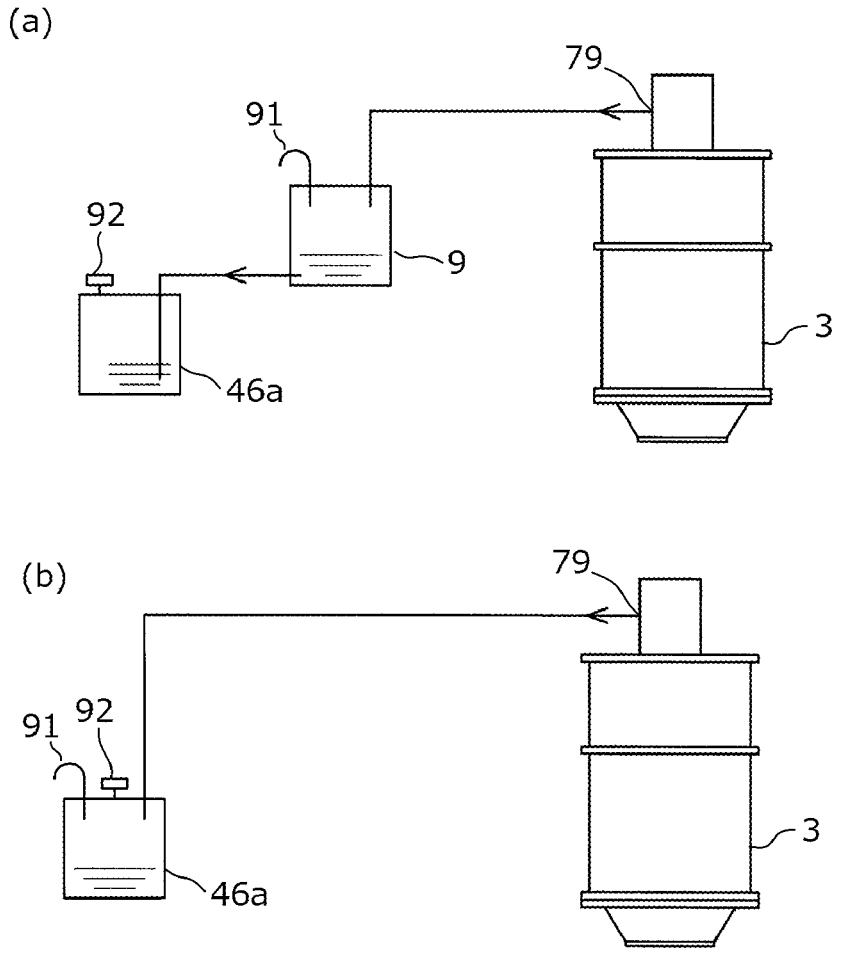
FIG. 4 shows the gas collecting configuration from the shaft sealing mechanism of the bearing mechanism.

Therefore, according to this embodiment, piping for collecting the gas is connected to the gas outlet 76, and the piping for collection is coupled to the oil tank 46*a* of the oil unit 46 as shown in FIG. 4(*a*). Furthermore, for high-pressure use, in which case the internal pressure of the casing 3 is 0.1 MPa or more during centrifugal separation, a buffer tank 9 serving as a mist collecting device is disposed at an intermediate position of the piping. The buffer tank 9 has a structure that opens to the atmosphere by means of a vent 91 in order to decrease the pressure of the collected gas. In this manner, the mist can be liquefied by once supplying the gas into the buffer tank 9 and can then be collected into the oil tank 46*a*. The gas from which the mist has been removed is released through the vent 91. For high-pressure use, unless such a configuration is adopted, the mist leaks through an air-breather 92 of the oil tank 46*a*. For normal-pressure use, in which case the internal pressure of the casing 3 during centrifugal separation is less than 0.1 MPa, the buffer tank 9 may be omitted. In this case, the oil tank 46*a* doubles as the mist collecting device.

According to the above-described embodiment, in the vertical decanter 1, a configuration is adopted in which the clearance between the housing 42 and the shaft 4 is sealed using the contactless shaft sealing mechanism 44 that achieves shaft sealing with the pressure gas, and thus forced circulation of the lubricating oil is no longer necessary. Furthermore, the sealing characteristics can be changed by adjusting the gas pressure, and the conventionally performed on-site work for adjusting the pressure balance by adjusting the gaps, shapes, and the like of various components constituting the bearing mechanism 41 (e.g., providing a clearance bushing) is no longer necessary. Consequently, there is no longer the necessity to change the pressure-resistant design specifications of the bearing mechanism 41 depending on the processing pressure, like for normal-pressure use or for high-pressure use, and thus it is possible to realize standardization of products.

Furthermore, according to the above-described embodiment, the necessity for forced circulation of the oil for shaft sealing is eliminated by adopting the contactless shaft sealing mechanism 44, and accordingly an energy-saving effect of reducing the power consumption of the oil unit 46 is achieved. It goes without saying that the size of the oil unit 46 can also be reduced. Furthermore, in the case of the contactless mechanism, unlike a mechanical seal, deterioration of the sealing characteristics due to wear of a sliding contact portion does not occur. Also, the contactless shaft sealing mechanism 44 suffers less deterioration of the sealing characteristics that is caused by intrusion of fine powder, and it is thus possible to maintain the sealing characteristics for a long period of time even in the case where a matter to be processed is a material, such as terephthalic acid, that causes fine powder to be diffused in the casing 3.

The above-described embodiment has a configuration in which the bearings 43 (43A, 43B) are lubricated by forced circulation of the oil. Since the two types of fluids, the lubricating oil and the sealing gas, are dealt with, the internal structure of the bearing mechanism 41 is designed as shown in FIGS. 2 and 3 so as to prevent the two types of fluids from adversely affecting each other within the bearing mechanism 41. However, a change of the method for lubricating the bearings 43 (43A, 43B) from oil lubrication to grease lubrication is not restricted. The above-described embodiment can be realized by changing the shaft sealing mechanism of an existing decanter, and therefore has an additional advantage that the existing decanter can be effectively used.

EXAMPLE

As described above, a decanter is likely to generate vibrations during centrifugal separation due to its structure. The contactless shaft sealing mechanism achieves sealing by forming a static pressure space in a slight gap and is therefore difficult to apply to an apparatus that is subject to vibrations. A horizontal decanter in which the bowl is placed in a horizontal orientation and supported at both ends generates larger vibrations than a vertical decanter due to bending, and therefore the shaft sealing mechanism easily deteriorates due to wear and cannot be put into practical use.

On the other hand, with respect to the vertical decanter 1, the amplitude of vibrations in the horizontal direction near the bearing mechanism 41 may be generally about 50 to 100 μm, and may be at the most 300 μm. The inventor of the present invention conducted a test by incorporating the contactless shaft sealing mechanism 44 into a decanter 1 with respect to which the amplitude of vibrations is 170 μm. The amplitude of vibrations of this decanter 1 increased to 300 μm during the test, and the amount of leakage of the gas increased from an initial rate of 100 N liters/minute to a rate of 170 N liters/minute. However, the matter to be processed did not leak from the casing 3, and the amount of lubricating oil within the circulating system did not decrease. Therefore, it was confirmed that reliable shaft sealing could be achieved. That is to say, because the decanter 1 is of a vertical type, the contactless shaft sealing mechanism can be put into practical use.

While the present invention has been described in detail in conjunction with specific embodiments, it is apparent to persons of ordinary knowledge in this technological field that various substitutions, modifications, changes, and the like to the forms and details can be made without departing from the spirit and scope of the invention that are defined in the description of claims. Therefore, the scope of the invention is not limited to the above-described embodiments and the accompanying drawings but should be defined by the claims and their equivalents.

DESCRIPTION OF REFERENCE NUMERALS

1 decanter
2 bowl
3 casing
31 drive motor
4 shaft
41 bearing mechanism
42 housing
43 bearing
44 shaft sealing mechanism

What is claimed is:

1. A vertical centrifugal separator comprising:

a casing constituting a vessel;

a centrifugal separation bowl that is rotatably disposed within the casing;

a rotary shaft of the bowl, the rotary shaft being provided on an upper side of the bowl and extending in a vertical axis direction;

a drive unit that is disposed outside the casing and rotates the rotary shaft; and a bearing mechanism that is disposed in an opening of the casing and rotatably supports the rotary shaft passing through the opening, wherein the bearing mechanism includes a housing that surrounds the rotary shaft, a bearing that rotatably supports the rotary shaft, and a shaft sealing mechanism that is disposed at an end portion of the bearing mechanism on the side of the casing and seals a clearance between the housing and the rotary shaft, and the shaft sealing mechanism is a contactless shaft sealing mechanism in which a rotary sealing ring is disposed on the side of the rotary shaft of the bowl, a stationary sealing ring including a seal assembly that opposes the rotary sealing ring is disposed on the side of the housing, and sealing is achieved by forming a static pressure space between the rotary sealing ring and the seal assembly using a sealing pressure gas whose pressure is adjustable, the pressure gas being introduced from outside.

2. The centrifugal separator according to claim 1, wherein a first outlet through which a lubricating oil for the bearing is discharged and a second outlet through which the sealing gas leaking from the shaft sealing mechanism is discharged are formed in that order from above in a portion of the clearance that extends from the bearing to the shaft sealing mechanism.

3. The centrifugal separator according to claim 2, further comprising:

a flowing-down preventing member that rotates together with the rotary shaft, thereby preventing the lubricating oil from flowing down to the shaft sealing mechanism, the flowing-down preventing member being located between the first outlet through which the lubricating oil for the bearing is discharged and the second outlet through which the sealing gas leaking from the shaft sealing mechanism is discharged.

4. The centrifugal separator according to claim 1, wherein a supply path for supplying the pressure gas to the contactless shaft sealing mechanism and a collecting path for collecting the sealing gas leaking from the shaft sealing mechanism are connected to the bearing mechanism, and a mist collecting device is further connected to the sealing gas collecting path.

5. The centrifugal separator according to claim 4, wherein the sealing gas collecting path is connected to a tank that stores the lubricating oil for the bearing, and when the centrifugal separator is a centrifugal separator for high-pressure use in which an internal pressure of the casing is 0.1 MPa or more during centrifugal separation, the mist collecting device is a buffer tank that opens to atmosphere, the buffer tank being disposed at an intermediate position of the collecting path.

6. The centrifugal separator according to claim 4, wherein the sealing gas collecting path is connected to a tank that stores the lubricating oil for the bearing, and when the centrifugal separator is a centrifugal separator for normal-pressure use in which an internal pressure in the casing is less than 0.1 MPa during centrifugal separation, the tank that stores the lubricating oil has a structure that opens to atmosphere, and the tank doubles as the mist collecting device.

* * * * *